US010079093B2

(12) United States Patent
Frey et al.

(10) Patent No.: US 10,079,093 B2
(45) Date of Patent: Sep. 18, 2018

(54) INDUCTIVE COMPONENT, AND DEVICE, AND METHOD FOR WINDING A WIRE FOR AN INDUCTIVE COMPONENT

(71) Applicant: EPCOS AG, Munich (DE)

(72) Inventors: Karsten Frey, Giengen (DE); Jürgen Frey, Heidenheim (DE); Wolfgang Porisch, Egloffstein (DE)

(73) Assignee: EPCOS AG, München (DE)

( * ) Notice: Subject to any disclaimer, the term of this patent is extended or adjusted under 35 U.S.C. 154(b) by 68 days.

(21) Appl. No.: 15/034,361

(22) PCT Filed: Nov. 25, 2014

(86) PCT No.: PCT/EP2014/075531

§ 371 (c)(1),
(2) Date: May 4, 2016

(87) PCT Pub. No.: WO2015/075261

PCT Pub. Date: May 28, 2015

(65) Prior Publication Data

US 2016/0268043 A1 Sep. 15, 2016

(30) Foreign Application Priority Data

Nov. 25, 2013 (DE) ..... 10 2013 113 005

(51) Int. Cl.
*B21D 7/024* (2006.01)
*H01F 41/061* (2016.01)
(Continued)

(52) U.S. Cl.
CPC ..... *H01F 41/061* (2016.01); *B21D 7/024* (2013.01); *H01F 27/2823* (2013.01);
(Continued)

(58) Field of Classification Search
CPC ..... B21D 7/02; B21D 7/7022; B21D 7/7024; B21D 7/708; B21D 7/7085; H01F 41/061; H01F 41/074; H01F 41/082
See application file for complete search history.

(56) References Cited

U.S. PATENT DOCUMENTS 3,538,737 A * 11/1970 Del Monica ..... B21D 7/022 72/31.05
5,331,729 A 7/1994 Moorehead
(Continued)

FOREIGN PATENT DOCUMENTS

DE 2410898 A1 9/1975
DE 2506777 A1 8/1976
(Continued)

*Primary Examiner* — Edward Tolan
(74) *Attorney, Agent, or Firm* — Slater Matsil, LLP

(57) ABSTRACT

An inductive component, a device, and a method for winding a wire for an inductive component are disclosed. In an embodiment a device includes an advancing arrangement configured to advance a wire and a shaping arrangement and a pitch-producing arrangement configured to bend the wire, wherein the shaping arrangement and the pitch-producing arrangement are arranged in such a way that the wire, as it is advanced by the advancing arrangement, is introduced into the shaping arrangement and the pitch-producing arrangement, and wherein the shaping arrangement and the pitch-producing arrangement are formed in such a way that the wire, as it is advanced, is bent in a coiled manner in the shaping arrangement and the pitch-producing arrangement.

10 Claims, 7 Drawing Sheets

(51) Int. Cl.

| | |
|---|---|
| ***H01F 27/28*** | (2006.01) |
| ***H01F 41/08*** | (2006.01) |
| ***H01F 41/077*** | (2016.01) |
| ***H01F 41/082*** | (2016.01) |
| *B21D 7/08* | (2006.01) |

(52) U.S. Cl.

CPC ..... *H01F 27/2847* (2013.01); *H01F 27/2895* (2013.01); *H01F 41/077* (2016.01); *H01F 41/08* (2013.01); *H01F 41/082* (2016.01); *B21D 7/085* (2013.01)

(56) References Cited

U.S. PATENT DOCUMENTS

| | | | | |
|---|---|---|---|---|
| 6,007,015 | A | 12/1999 | Kinutani et al. | |
| 2004/0100347 | A1 | 5/2004 | Okamoto | |
| 2008/0055035 | A1 | 3/2008 | Gerhard | |
| 2009/0065623 | A1 | 3/2009 | Touzet | |
| 2010/0308950 | A1 | 12/2010 | Hsieh et al. | |
| 2011/0005064 | A1 | 1/2011 | Klesyk et al. | |
| 2011/0048092 | A1* | 3/2011 | Saigo | H02K 15/045 72/146 |
| 2011/0090038 | A1 | 4/2011 | Perchlik | |
| 2012/0037264 | A1 | 2/2012 | Sakabe et al. | |
| 2012/0146756 | A1 | 6/2012 | Roellgen et al. | |
| 2013/0154782 | A1 | 6/2013 | Won et al. | |
| 2014/0218157 | A1 | 8/2014 | Liu et al. | |
| 2014/0266541 | A1 | 9/2014 | Sakamoto et al. | |
| 2015/0302988 | A1* | 10/2015 | Shirai | H01F 41/065 72/142 |

FOREIGN PATENT DOCUMENTS

| | | | |
|---|---|---|---|
| DE | 3540098 | A1 | 5/1987 |
| DE | 19739520 | A1 | 3/1998 |
| DE | 102008025590 | A1 | 12/2009 |
| DE | 102009036396 | A1 | 2/2011 |
| DE | 102011100434 | A1 | 11/2012 |
| EP | 2337198 | A2 | 6/2011 |
| JP | H03237704 | A | 10/1991 |
| JP | 2002198245 | A | 7/2002 |
| JP | 2004158653 | A | 6/2004 |
| JP | 2004273518 | A | 9/2004 |
| JP | 2004327461 | A | 11/2004 |
| JP | 2006288025 | A | 10/2006 |
| JP | 2010093139 | A | 4/2010 |
| JP | 2011050215 | A | 3/2011 |
| JP | 2011130554 | A | 6/2011 |
| JP | 2011187717 | A | 9/2011 |
| JP | 2012054480 | A | 3/2012 |
| JP | 2012059689 | A | 3/2012 |
| JP | 2013089896 | A | 5/2013 |

* cited by examiner

INDUCTIVE COMPONENT, AND DEVICE, AND METHOD FOR WINDING A WIRE FOR AN INDUCTIVE COMPONENT

This patent application is a national phase filing under section 371 of PCT/EP2014/075531, filed Nov. 25, 2014, which claims the priority of German patent application 10 2013 113 005.4, filed Nov. 25, 2013, each of which is incorporated herein by reference in its entirety.

TECHNICAL FIELD

The invention relates to a device for winding a wire, which, for example, can be used as an air coil or as part of an inductive component, in particular as a winding of a transformer.

BACKGROUND

In order to produce inductive components, for example, an air coil or a transformer, it is necessary to deform a wire accordingly. In order to produce an air coil, the wire, for example, must be wound in a coiled manner. In order to produce a transformer it is necessary to wind the wire around a leg of the transformer. If the transformer has a closed core, an automated direct winding of the closed core poses a particular challenge.

Up to a certain ratio of wire cross section, winding spiral diameter, number of turns and core cross section, it is possible to a limited extent to "rotate" pre-shaped air coils onto a closed core of a transformer. The coiled air coil, which assimilates a tension spring, for this purpose must be spread apart until the core cross section can be overcome. During this process however, which is generally very complex and time-consuming, high mechanical forces act on the core that is to be wound. Due to the splaying of the "tension spring" to form a "compression spring", the possible degree of filling of a closed core is necessarily limited or the "tension spring" produces mechanical stresses permanently. The ferrite core materials generally used for a transformer, however, are very sensitive with respect to the action of mechanical stresses.

The production of transformers that have a closed core and in which flat wires of rectangular cross section (rectangular wires) are used instead of round wires for the winding is particularly challenging. This transformer type enables the conduction of currents of high amperage with high inductance of the component caused by the high number of turns that can be attained. A rectangular or flat wire usually can no longer be applied to a closed core in an automated manner, and this is therefore generally very time-consuming.

SUMMARY

Embodiments of the inventions provide a device for winding a wire, with which device it is made possible to wind a wire, in particular a rectangular or flat wire, in an automated manner as an air coil or to wind said wire around a closed core of a transformer. Furthermore, a method for winding a wire will be specified, with which method it is made possible to wind a wire, in particular a rectangular or flat wire, in an automated manner as an air coil or to wind said wire around a closed core of a transformer. The device and the method can also be used to wind a round wire.

Embodiments specify a device of this type for winding a wire. The device comprises an advancing arrangement for advancing the wire, a shaping arrangement, and a pitch-producing arrangement for bending the wire. In particular, the shaping arrangement serves to bend the wire in a plane and the pitch-producing arrangement serves to bend the wire from the plane with a pitch. By way of example, the pitch-producing arrangement is arranged after the shaping arrangement. The pitch-producing arrangement can also be integrated in the shaping arrangement, such that the wire, when bent in a circular manner in the shaping arrangement, also is provided with a pitch at the same time. The shaping arrangement and the pitch-producing arrangement are arranged in such a way that the wire, as it is advanced by the advancing arrangement, is introduced into the shaping arrangement and the pitch-producing arrangement. The shaping arrangement and the pitch-producing arrangement are designed in such a way that the wire, as it is advanced, is bent in a coiled manner in the shaping arrangement and the pitch-producing arrangement.

Further embodiments specify a method for winding a wire. The method provides a device, in particular the above-specified device, for winding the wire. The wire is advanced in the device in such a way that the wire is fed to a shaping arrangement and a pitch-producing arrangement. As the wire is guided through the shaping arrangement and the pitch-producing arrangement it is bent in a coiled manner. By way of example, the wire is bent in the plane as it passes through the shaping arrangement and is bent out from the plane with a pitch by the pitch-producing arrangement.

By means of the specified device and by the specified method, practically any cross sections, preferably thick and therefore very rigid cross sections, of a wire, in particular of a rectangular or flat wire, can be wound in an automated manner very quickly and directly onto closed core cross sections. The compressed "compression spring" of the winding is retained. The core can be wound practically completely, without generating mechanical stresses in the winding direction and therefore practically with no mechanical forces acting on the core.

In accordance with a possible embodiment the device for winding the wire can contain a guide arrangement for guiding the wire in the plane, wherein the guide arrangement has a straight course in the plane. The wire is laid in the guide arrangement and is slid by means of the advancing arrangement into the shaping arrangement, which is arranged after the guide arrangement in the advancing direction of the wire. The advancing arrangement can be formed, for example, as an eccentric reciprocating press. By means of the device, a type of "wire thrust procedure" is provided, with which very high thrusts can be introduced onto the wire guided in the guide arrangement and the shaping arrangement.

The shaping arrangement can be formed as an indentation in a plate. The wire can then be bent in the plane of the plate by the shaping arrangement. The shaping arrangement has a base face, on which the wire rests, and a curved side wall. As the wire is advanced from the guide arrangement into the shaping arrangement, the wire is guided, resting on the base face, along the curved side wall. The side wall may be curved in a semi-circular manner, such that the wire is bent in a circular manner. The wire is bent out from the plane of the plate by the pitch-producing arrangement, such that a coiled turn of the wire is produced as a result of the circular bending. The shape of the wire can also be described as "helical" or "spiraled" in the sense of a cylindrical spiral.

The device is suitable in particular for bending a flat wire, wherein the flat wire rests via its larger side face on the base face of the shaping arrangement and bears via its smaller side face against the side wall of the shaping arrangement.

In order to prevent the wire from tipping over in the shaping arrangement, the side of the indentation, which can be open, opposite the base face can be covered by a displaceable cover arrangement. This special shaping member thus prevents the natural tendency of the wire to tip over during bending. Due to the pitch-producing arrangement, the wire is provided with a pitch, such that it exceeds its own height after a turn and is bent over a portion of the wire arranged there beneath.

The device can have a receiving arrangement for positioning a core, in particular a closed core, of an inductive component, for example, of a transformer. The shaping arrangement and the pitch-producing arrangement are arranged around the receiving arrangement in such a way that the wire, as it is advanced through the shaping arrangement and the pitch-producing arrangement, can be wound in a coiled manner around a leg of the closed core, without damaging the sensitive coating of the wire, for example, of an enameled copper wire, or the insulation coating of the core. An otherwise conventional winding mandrel is unnecessary. By means of the device, flat or rectangular wires having a width of, for example, 5 mm and a thickness from 1 mm to 2 mm can be bent in a coiled manner as air coils or can be bent in a coiled manner around a leg of a closed frame core of a transformer.

When bending flat or rectangular wires having a thickness of the wire of more than 1.8 mm, an end portion of the wire can be pre-bent by a pre-bending arrangement of the device. For this purpose the wire is clamped in the advancing arrangement in such a way that the end portion of the wire to be pre-bent protrudes from the device on the side on which the guide arrangement or the shaping arrangement is arranged. By means of the pre-bending arrangement, the end portion of the wire is bent in such a way that the wire can then be laid in the upwardly open indentation of the shaping arrangement. The wire is bent further, as described above, in an automated manner by advancement of the wire through the shaping arrangement and the pitch-producing arrangement.

In accordance with a further aspect of the present invention an inductive component is specified. The component is preferably produced by the method described above. The wire is wound in particular in a circular manner with a pitch, i.e. in a coiled manner.

In one embodiment the winding of the wire is compressed. With a compressed winding, adjacent turns bear closely against one another. In particular, the winding is free from gaps or is practically free from gaps, such that adjacent turns bear directly against one another. By way of example the lead of the coiled winding lives in the region of the wire thickness. In this way, a particularly high degree of filling of the winding can be achieved.

The inductive component can have a core, in particular a ferrite core. The wire can be wound directly around the core. In particular, the wire is in this case not wound around a coil former made of plastic. In one embodiment the core has a closed shape. The inductive component can also be formed as an air coil.

The wire can be formed, for example, as a rectangular or flat wire. Alternatively, it may also be a round wire.

In one embodiment the core in cross section has an outer peripheral line that is not circular. In particular, the core can have edges. By way of example, the core has corners in cross section. In particular, the core can have an outer peripheral line in the form of a polygon.

BRIEF DESCRIPTION OF THE DRAWINGS

The invention will be explained in greater detail hereinafter on the basis of figures, which show embodiments of the present invention and in which.

DETAILED DESCRIPTION OF ILLUSTRATIVE EMBODIMENTS

Figure 1:
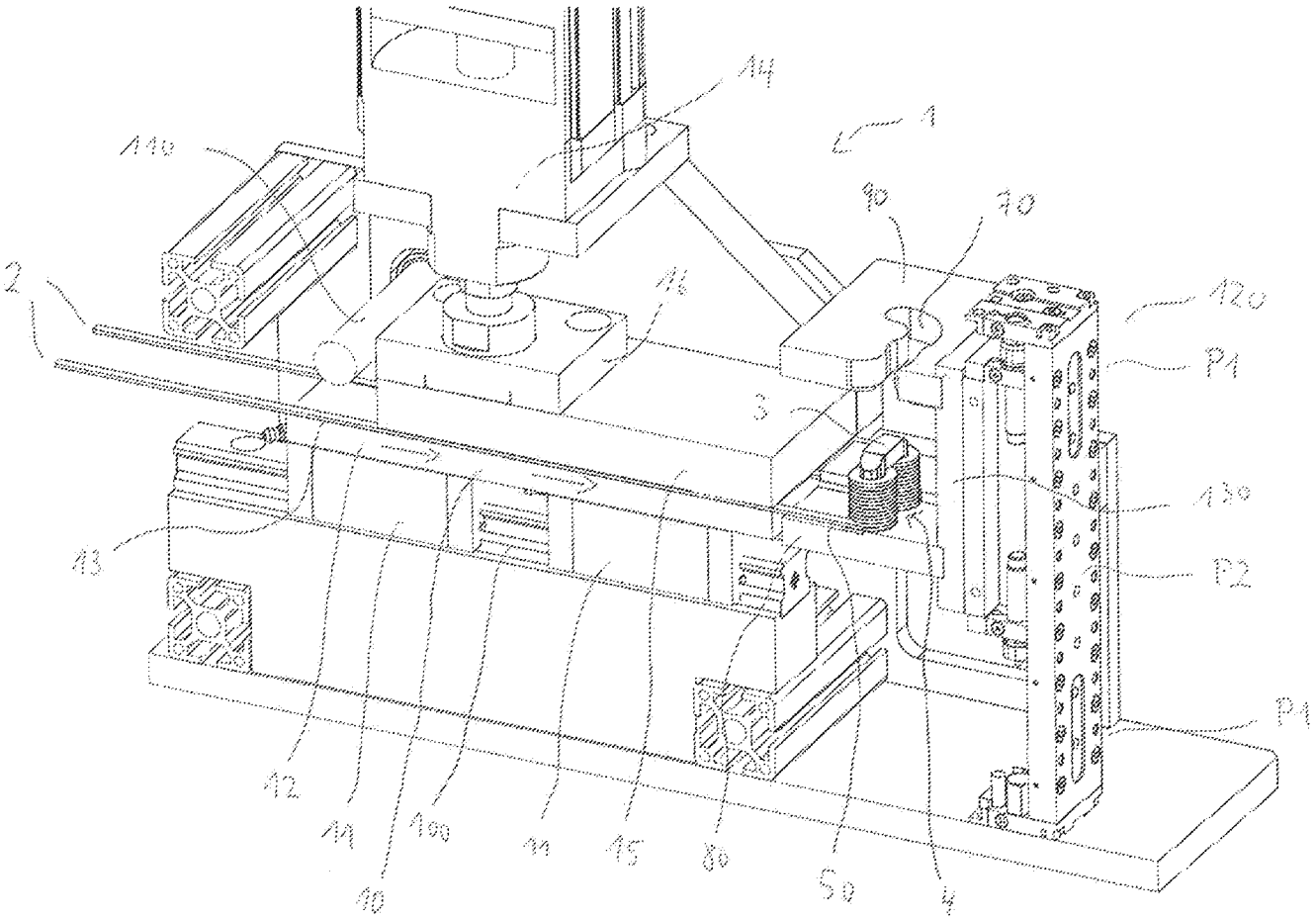
FIG. 1 shows an embodiment of a device for winding a wire.

FIG. 1 shows an embodiment of a device 1 for winding a wire 2, which can be wound by means of the device 1 in a coiled manner as an air coil or around a leg of a closed frame core 3 of an inductive component 4, for example, of a transformer. By means of the device 1, in particular two wires 2 guided in parallel can be wound simultaneously around two legs of a closed frame core 3.

The device 1 comprises an advancing arrangement 10 for advancing the wire in a guide arrangement 50 for guiding the wire 2. The advancing arrangement 10 has a carriage 11, which is arranged movably on a rail 100. In the exemplary embodiment of FIG. 1 the device 1 comprises two carriages 11, which are arranged on the rail 100 so as to be displaceable in the horizontal direction. A plate 12 of the advancing arrangement, which on its upper side has at least one guide 13 for guiding at least one wire 2, is disposed above the carriage 11. The guide 13 can be formed as an indentation in the plate 12. For the parallel guidance of the two wires 2 shown in FIG. 1, two guides 13 can be arranged in parallel in the plate 12, as in the case of the embodiment of the device 1 for winding the wire shown in FIG. 1.

In order to cover the upwardly open guide 13 in the plate 12, a cover plate 15 can be arranged at least in part on the plate 12. The cover plate 15 can be pressed onto the plate 12 by means of a press 14, such that the open side of the guide 13 is covered by the cover plate 15 and the wire 2 is clamped in the guide 13. In order to press the cover plate 15 onto the guide 13, a punch 16 is provided above the press 14 and presses the cover plate 15 onto the plate 12 having the guide 13. The plate 12, the cover plate 15 and the punch 17 can be moved back and forth with the movement of the carriage 11 in the horizontal advancing direction of the wire shown by the arrows on the plate 12.

In order to move the advancing arrangement 10, a drive unit 110 is provided. In the case of the forward movement of the wire 2 in the direction of the frame core 3, the wire 2 is fixedly pressed in the guide 13 by means of the cover plate 15 and is therefore advanced along the guide arrangement 50. The press then raises the cover plate 15, such that the wire is no longer clamped in the guide 13 of the plate 12.

The carriage 11 then moves the plate 12 back again into the starting position. The advancing process of the wire is then repeated.

Figure 2:
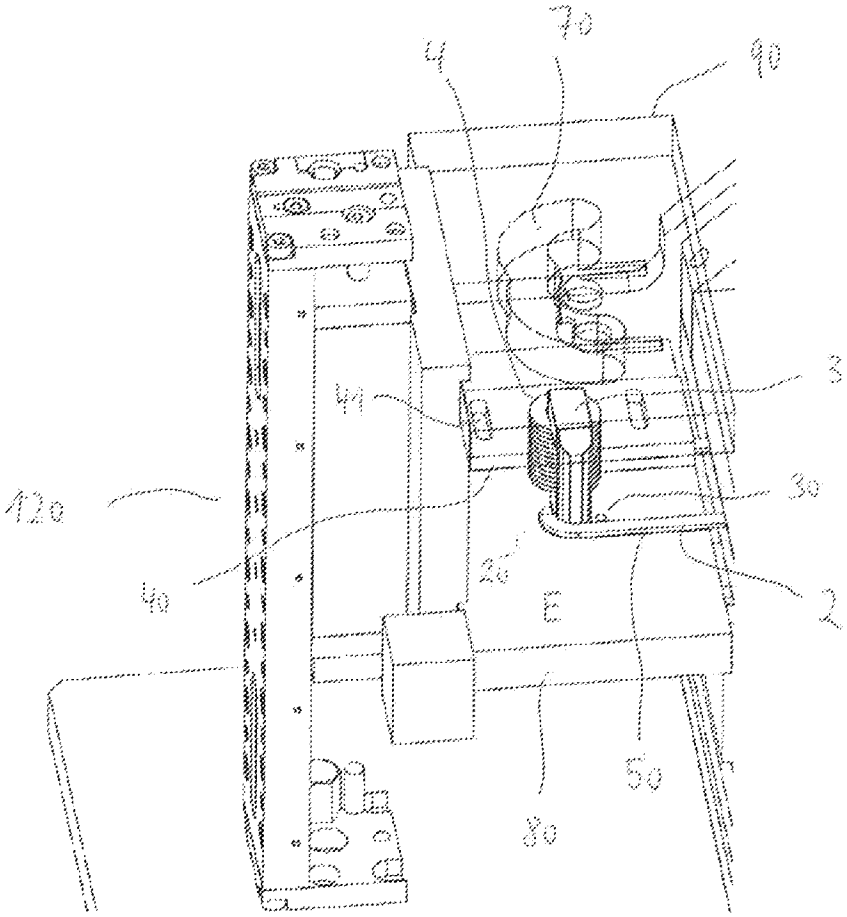
FIG. 2 shows a detail of the device for winding a wire.
Figure 3:
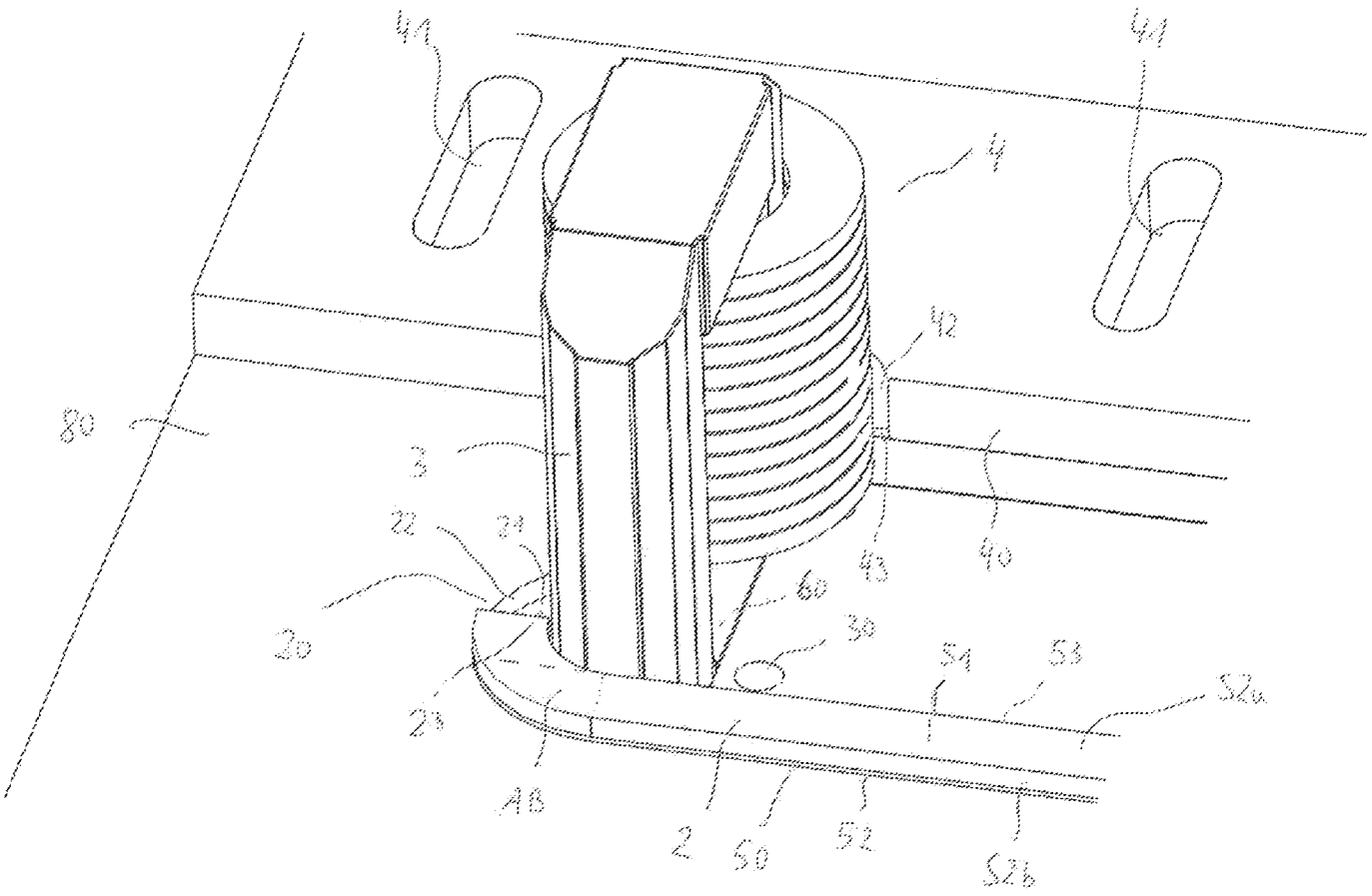
FIG. 3 shows a further detail of the device for winding a wire.

FIGS. 2 and 3 show an enlarged illustration of a front region of the device 1 with a guide arrangement 50 for guiding the wires 2. The guide arrangement 50 is arranged as an indentation in a plate 80. The guide arrangement 50 has a straight course in a plane E of the plate 80. As is clear on the basis of FIGS. 1, 2 and 3, the device 1, besides the advancing arrangement 10 and the guide arrangement 50, has a shaping arrangement 20 for bending the wire 2 in the plane E and also a pitch-producing arrangement 30 for bending the wire 2 out from the plane E with a pitch.

The shaping arrangement 20 and the pitch-producing arrangement 30 are formed in such a way that the wire 2 when advanced by the advancing arrangement 10 is advanced firstly in the guide arrangement 50 in the longitudinal direction and is then introduced into the shaping arrangement 20 and the pitch-producing arrangement 30. The shaping arrangement 20 and the pitch-producing arrangement 30 are formed in such a way that the wire 2, as it is advanced, is bent in a coiled manner in the shaping arrangement 20 and the pitch-producing arrangement 30.

The shaping arrangement 20 and the guide arrangement 50 can be formed as part of the plate 80 common thereto. The shaping arrangement 20 can have an indentation 23 in the plate 80, wherein the indentation has a curved course in the plane E of the plate. By way of example, the indentation can be bent in the shape of a segment of a circle, in particular in a semi-circular manner. The shaping arrangement 20 can have a base face 21, on which the wire 2 rests, and at least one side wall 22. The at least one side wall 22 has the curved course. The shaping arrangement 20 is thus formed in such a way that the wire 2, as it is advanced, is bent in the shaping arrangement 20 in a circular manner along the side wall 22.

The guide arrangement 50 can have an indentation 53 in the plate 80, which indentation has a straight course in the plane E of the plate and leads into the indentation 23 of the shaping arrangement 20. The guide arrangement 50 has a base face 51 and a side wall 52, which are arranged at right angles to one another and thus form the indentation 53 within the plate 80.

The shaping arrangement 20 and the guide arrangement 50 are designed in particular to guide a rectangular or flat wire. Here, a rectangular or flat wire is to be understood to mean a wire having a rectangular cross section, which has a larger and a smaller side face, wherein the side faces are arranged at right angles to one another. In FIGS. 1 to 3 the wire 2 is formed as a flat or rectangular wire having a larger side face S2*a* and a smaller side face S2*b*.

As the wire is advanced in the guide arrangement 50, the flat or rectangular wire 2 rests via the larger side face S2*a* on the base face 51 of the guide arrangement 50. The smaller side face S2*b* of the flat or rectangular wire 2 bears against the side wall of 52 of the guide arrangement 50. The shaping arrangement 20 adjoining the guide arrangement 50 in the shown exemplary embodiment is formed in such a way that the flat or rectangular wire 2, as it is guided and bent in the shaping arrangement 20, rests via the larger side face S2*a* on the base face 21 of the shaping arrangement and bears via the smaller side face S2*b* on the side wall 22 of the shaping arrangement.

As the wire 2 is bent in the shaping arrangement 20, the outer region of the wire, which bears more closely than an inner region of the wire against the side wall 22 of the shaping arrangement 20, is stretched, whereas the inner region of the wire is compressed during the bending. The shaping arrangement 20 can be open on the side opposite the base face 21. In order to prevent the flat or rectangular wire from tipping over in the shaping arrangement 20 on account of the stresses in the material of the wire 2 occurring during the bending, the device 1 can comprise a displaceable cover arrangement 40.

The cover arrangement 40 can be arranged displaceably on the plate 80. The cover arrangement 40 can be displaced on the plate 80 in such a way that the guide arrangement 50 is covered completely and the shaping arrangement 20 is covered at least in part by the cover arrangement 40. In exemplary embodiment of FIGS. 2 and 3, for reasons of improved clarity, only a cover arrangement 40 is illustrated that completely covers the indentations in the rear guide arrangement 50 and partially covers the rear shaping arrangement 20.

The cover arrangement 40 can be formed as a plate arranged displaceably on the plate 80. The cover arrangement 40 is for this purpose displaceable on the plate 80 along the two recesses 41 transversely to the longitudinal direction of the wire 2 and therefore transversely to the longitudinal direction of the guide arrangement 50. Before the wire is introduced from the guide arrangement 50 into the shaping arrangement 20 by means of the advancing arrangement 10, the displaceable cover arrangement 40 is displaced in such a way that the guide arrangement 50 is covered completely and the shaping arrangement 20 is covered in part by the cover arrangement 40. The front region AB of the shaping arrangement 20 bordered by dashed lines in FIG. 3 with the portion of the wire lying therein is thus covered by the cover arrangement.

The plate of the cover arrangement 40 has a semi-circular recess 42 above the region AB of the shaping arrangement 20. At the lower end of the semi-circular recess, the cover arrangement has a thin plate 43 made of a hardened material. This plate 43 can be just a few tenths of a millimeter thick, for example. As the cover arrangement is displaced, the thin plate 43 arranged at the lower end of the recess 42 covers the wire 2 guided in the indentation of the shaping arrangement. As the wire enters the shaping arrangement, the thin plate 43 prevents the wire from popping out from or tipping over in the shaping arrangement 20. When the wire is wound in a coiled manner, an upper layer of the wire can be arranged above a lower layer of the wire, which is disposed in the shaping arrangement 20, once said wire has been guided through the pitch-producing arrangement. The upper layer of the wire lies above the plate 43, whereas the lower layer of the wire is guided below the plate 43 in the shaping arrangement. The lower layer and the upper layer, arranged thereabove, of the wire winding are separated from one another during the winding process by the thin plate 43.

In the embodiment shown in FIGS. 1 to 3 of the device 1 for bending the wire, the guide arrangement 50 and therefore also the plate 80 are arranged after the advancing arrangement 10 in the advancing direction of the wire 2. The shaping arrangement 20 is arranged after the guide arrangement 50 in the advancing direction of the wire, such that the wire 2, as it is advanced, is slid from the guide arrangement 50 into the shaping arrangement 20. The pitch-producing arrangement 30 can be arranged after the shaping arrangement 20, such that the wire 2, as it is advanced following the shaping in the shaping arrangement 20, is guided to the pitch-producing arrangement 30. The pitch-producing arrangement 30 can also be integrated in the shaping arrangement. In this embodiment the base face 21 of the shaping arrangement rises in the horizontal direction, such that the wire is also provided with a pitch as it is bent in a circular manner in the shaping arrangement.

Figure 4:
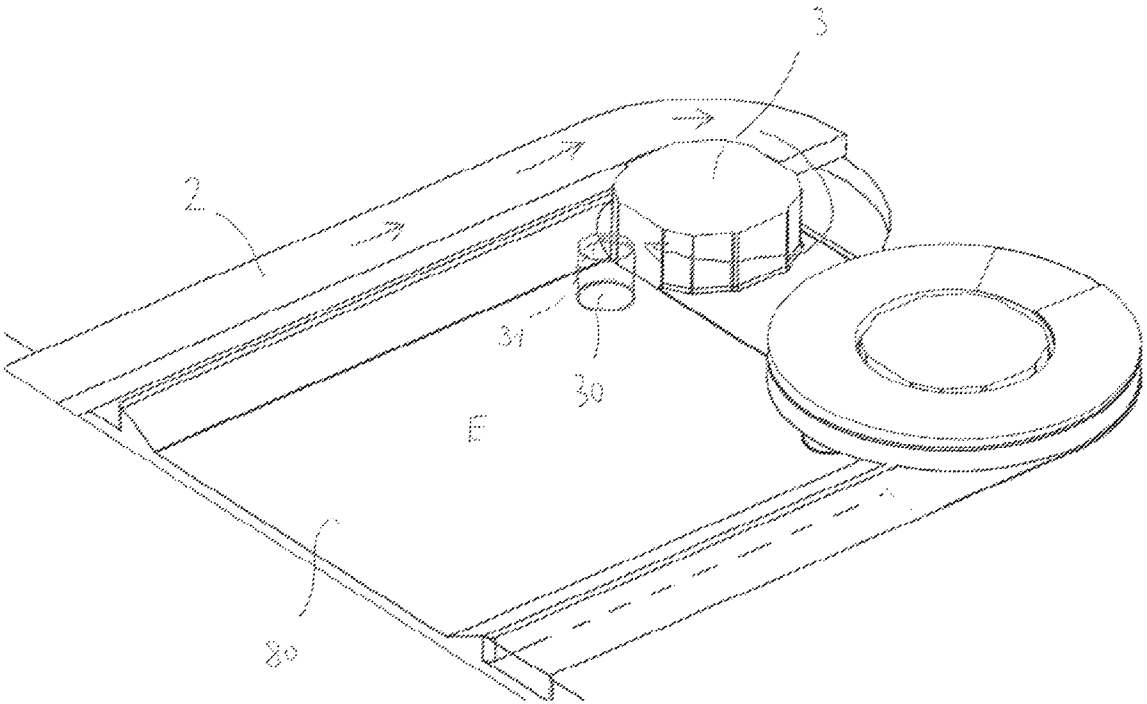
FIG. 4 shows an embodiment of a pitch-producing arrangement.

In the embodiment of the device 1 shown in FIGS. 1 to 3 the pitch-producing arrangement 30 is arranged after the shaping arrangement 20. The pitch-producing arrangement 30 can have, for example, an inclined plate in order to produce the pitch of the wire. The inclination of the plate can be adjusted depending on the pitch of the wire. FIG. 4 shows the wire 2 guided in the guide arrangement 50 and the shaping arrangement 20, which wire is wound around the leg 3 (illustrated in a shortened manner) of the inductive component 4, and the pitch producer 30. In the embodiment illustrated in FIG. 4 the pitch producer 30 is formed as a ballpoint pen. The pitch producer by way of example has a cylindrical body with a spherical curvature 31 at its upper end. The pitch producer is arranged on the plate 80 or can be recessed in the plate 80.

Depending on the pitch, the pitch producer can be raised from the plane E of the plate 80. As the wire 2 is wound, the wire runs over the spherical curvature 31 and is provided with a pitch on account of the spherical shape, which pitch is necessary in order to produce the actual coiled winding of the wire and therefore more than one turn of the wire. In order to bend the wire out from the plane E of the plate 80, the pitch producer by way of example can be raised in accordance with the desired pitch, as soon as the wire has slid over the spherical curvature. Once the wire has slid over the inclined plate or the spherical curvature 31 of the pitch-producing arrangement, the wire is bent out from the plane E and can be placed over the portion of the wire arranged therebeneath, which is introduced at the same time into the shaping arrangement. The coiled winding of the wire is thus provided.

In order to wind the wire around a leg of the closed frame core 3, the device 1 has a receiving arrangement 60 for positioning the core 3 of the inductive component 4. The shaping arrangement 20 and the pitch-producing arrangement 30 are arranged around the receiving arrangement 60 in such a way that the wire 2 is wound in a coiled manner around the leg of the core 3 of the inductive component when the core 3 is positioned in the receiving arrangement 60 and the wire 2 is guided through the shaping arrangement 20 and the pitch-producing arrangement 30.

The bending or winding of the wire 2 by means of the device 1 will be explained in greater detail hereinafter. For the sake of simplicity, the method for winding a wire will be described only for one wire 2. However, as explained above, two wires can also be wound simultaneously around two different legs of a closed frame core by means of the device.

In order to lay the wire 2 in the advancing arrangement 10, the cover plate 15 is first raised from the plate 12, such that the wire 2 can be laid in the guide 13 and slid through the guide arrangement 50 as far as the start of the shaping arrangement 20. The cover plate 15 is then pressed by means of the press 14 and the punch 16 onto the plate 12, such that the wire 2 is clamped within the guide 13.

By means of the drive unit 110, the carriages 11 and therefore the plate 12 are advanced in the direction of the arrow, such that the front end of the wire is slid from the guide arrangement 50 into the shaping arrangement 20. As the wire 2 is advanced, the front portion of the wire, which is guided through the shaping arrangement 20, is bent in a semi-circular manner in the plane E of the plate 80.

In order to advance the wire further forwards, the cover plate 15 is raised by the punch 16 and the press 14, and the carriages 11 are slid back with the plate 12 secured thereon, against the direction of the arrows shown in FIG. 1. On account of the bending of the front end of the wire, the wire is fixed and is not slid back with the movement of the plate 12 and the carriages 11. In order to feed the wire further, the cover plate 15 is pressed again onto the plate 12, such that the wire is clamped again in the guide 13. The plate 12 is then moved forwards again by the carriages 11, whereby the wire 2 is slid further into the shaping arrangement 20 and is bent there in a semi-circular manner. The front end of the wire now reaches the pitch-producing arrangement 30 and is bent out from the plane E of the plate 80 as it is guided on through the pitch-producing arrangement 30. By sliding the wire further forwards, the wire can be bent by means of the device ultimately in a coiled manner, as is shown in FIGS. 1 to 3.

The described method for bending the wire by means of the device 1 can be carried out, for example, in order to bend a wire having a width of 5 mm and a thickness of 1.5 mm to 1.7 mm. For thicker wires, for example, rectangular or flat wires, having a thickness of more than 1.8 mm, the front end portion A of the wire 2 can be pre-bent before being slid into the guide arrangement 50 or the shaping arrangement 20. The device 1 for this purpose has the pre-bending arrangement 70 shown in FIGS. 1, 2, 5, 6 and 7 for bending the end portion A of the wire 2.

Figure 5:
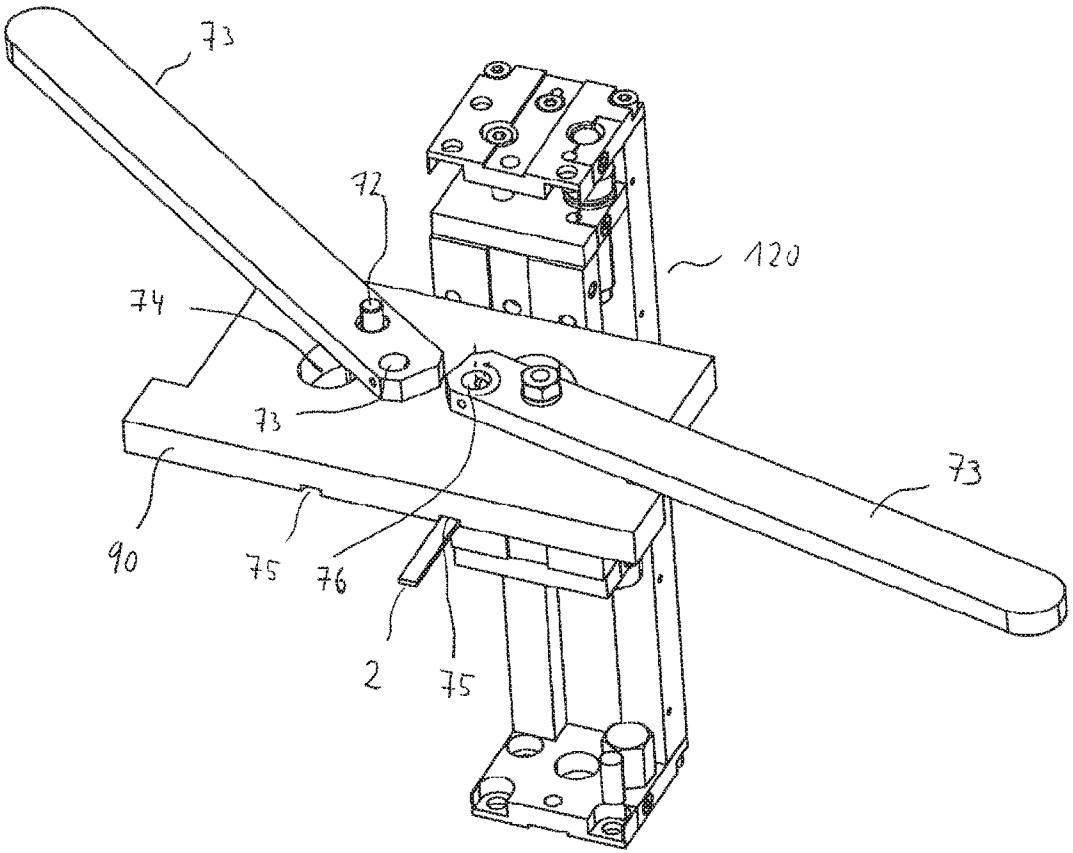
FIG. 5 shows a plan view of a first side of an embodiment of a pre-bending arrangement for bending an end portion of a wire.
Figure 6:
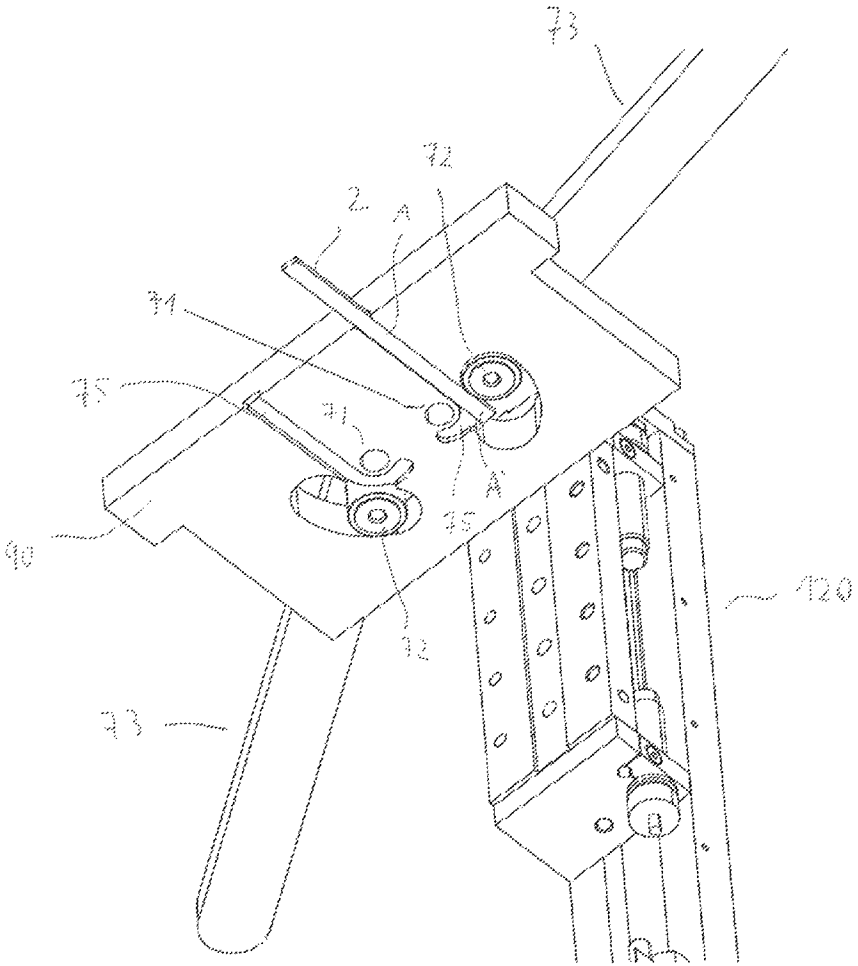
FIG. 6 shows a plan view of a second side of an embodiment of a pre-bending arrangement for bending an end portion of a wire.
Figure 7:
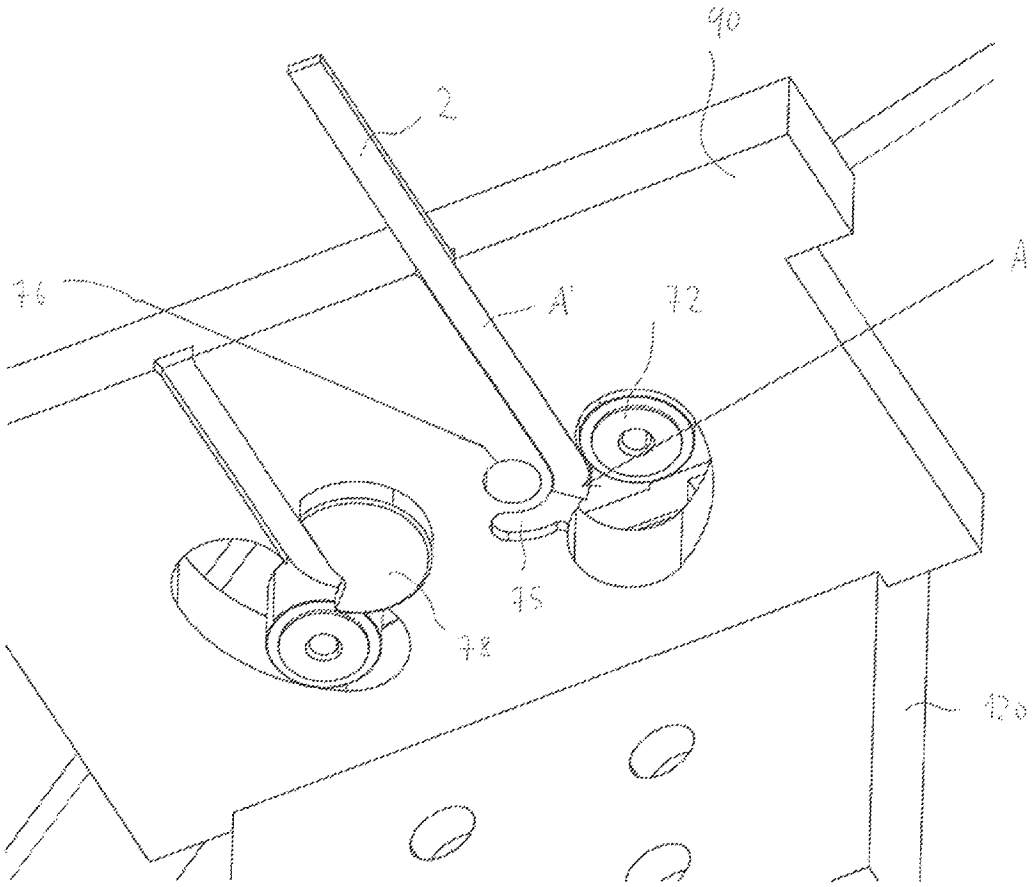
FIG. 7 shows a plan view of a second side of an embodiment of a pre-bending arrangement for bending an end portion of a wire.

The pre-bending arrangement 70 can be part of a plate 90, which is arranged on a mount 120 of the device 1 so as to be movable in the vertical direction. FIG. 5 shows an upper side of the pre-bending arrangement 70, whereas the underside of the pre-bending arrangement 70 is illustrated in FIGS. 6 and 7. The pre-bending arrangement 70 has a bending mandrel 71, about which the end portion A of the wire 2 can be bent. The bending mandrel 71 can be formed as a cylindrical journal which protrudes from the underside of the plate 90.

In order to actually bend the end portion A of the wire 2 around the bending mandrel 71, the pre-bending arrangement 70 has a bending element 72, which can be secured to a lever 73 as an entraining pin or a cylindrical roller. The lever 73 can be mounted rotatably at a joint 76. The pre-bending arrangement 70 also has, in the plate 90, a recess 74, in which the bending element 72 is arranged movably at a distance around the bending mandrel 71. The bending element 72 is movable within the recess 74 by means of the lever 73 along the path of a segment of a circle. The recess 74 is for this purpose likewise arranged in the form of a segment of a circle in the plate 90. In the embodiments shown in FIGS. 1 to 7 of the device for winding a wire, with which two wires can be wound simultaneously around different legs of the closed frame core 3, the material recess 74 in the plate 90 has two partial recesses, which are shaped in the form of a segment of a circle and transition into one another. For improved illustration, only one wire 2 having an end portion A, which is bent by means of the pre-bending arrangement 70, is provided in the embodiments of the pre-bending arrangement 70 shown in FIGS. 5, 6 and 7.

In order to pre-bend the end portion A of the wire 2, the wire is firstly clamped in the advancing arrangement 10, in such a way that the front end portion A of the wire protrudes from the advancing arrangement on the side of the advancing arrangement on which the guide arrangement 50 is arranged. The plate 80 with the guide arrangement 50, the shaping arrangement 20 and the pitch-producing arrangement 30 fixed on the plate is arranged displaceably on the mount 120. In order to pre-bend the end portion of the wire 2, the plate 80 is displaced along the mount 120 into a position P3. The pre-bending arrangement 70 is connected to the plate 80 via a coupling element 130. The coupling element 130 is arranged on the mount 120 so as to be displaceable in the vertical direction.

As the plate 80 is displaced into the position P3, the pre-bending arrangement 70 is therefore displaced accordingly downwardly into a position P2, at the height of which the wire 2 protrudes from the advancing arrangement 1. In order to receive the wire 2, the pre-bending arrangement 70 has the guide 75. Following the displacement of the plate 90 with the pre-bending arrangement 70 from a position P1 above the position P2 to the position P2, the portion A' of the wire 2 arranged after the end portion A lies in the guide 75 of the pre-bending arrangement, whereas the front portion A of the initially still unbent wire 2 protrudes from the guide 75, as is illustrated in FIG. 6.

By moving the lever 73 with the bending element 72 in the direction of the arrow about the joint or a pivot point 76, at which the lever 73 can be rotatably mounted and which, for example, is arranged on the upper side of the plate 90 on the bending mandrel 71, the end portion A of the wire is pre-bent in a semi-circular manner around the bending mandrel 71. FIG. 7 shows the pre-bent end portion A of the wire 2, which is bent in a curved portion of the guide 75. In order to hold the wire securely in the curved portion of the guide 75 along the bending mandrel, a cover 78 is provided over the curved portion of the guide 75. The cover 78 is arranged on the underside of the plate 80 and can have a cross section shaped in the form of a segment of a circle. For reasons of improved clarity, only one cover 78 is illustrated in FIG. 7.

Besides the wire shown in FIGS. 5, 6 and 7, a further second wire, which is guided in the device 1 parallel to the first wire, can be bent by means of the pre-bending arrangement 70. For this purpose the pre-bending arrangement has a further lever 73, which moves a further bending element in a further recess 74.

For further bending or winding of the wire 2, the plate 90 is moved with the pre-bending arrangement 70 from the position P2 back to the position P1. In so doing, the plate 80 is moved from the position P3, which lies below the position P2, back again to the position P2, whereby the front end portion A of the wire 2, which is now pre-bent, is laid in the guide arrangement 50 or the shaping arrangement 20. The wire can now be bent or wound around the leg of the closed frame core 3 in an automated manner by means of the device 1 as described above.

The invention claimed is:

1. A device for winding a wire for an inductive component, the device comprising:

an advancing arrangement configured to advance the wire; and a shaping arrangement and a pitch-producing arrangement configured to bend the wire, wherein the shaping arrangement and the pitch-producing arrangement are arranged such that the wire, as it is advanced by the advancing arrangement, is introduced into the shaping arrangement and the pitch-producing arrangement, wherein the shaping arrangement and the pitch-producing arrangement are formed such that the wire, as it is advanced, is bent in a coiled manner in the shaping arrangement and the pitch-producing arrangement, wherein the shaping arrangement has a base face for supporting the wire and at least one side wall, wherein the at least one side wall has a curved course, wherein the shaping arrangement is formed such that the wire, as it is advanced in the shaping arrangement, is bent along the side wall, wherein the shaping arrangement is open on a side opposite the base face such that a coil protrudes out of the shaping arrangement at a side opposite of the base face, and wherein the shaping arrangement is not located between adjacent windings in a protruding part.

2. The device according to claim 1, wherein the shaping arrangement is designed to guide a flat wire, which has a larger side face and a smaller side face, and wherein the shaping arrangement is formed such that the flat wire, as it is guided and bent in the shaping arrangement, rests via the larger side face on the base face of the shaping arrangement and bears via the smaller side face on the side wall of the shaping arrangement.

3. The device according to claim 1, further comprising at least one displaceable cover arrangement, wherein the cover arrangement is designed to be displaceable into a position in which the cover arrangement covers the shaping arrangement on the side opposite the base face.

4. The device according to claim 1, further comprising a guide arrangement for guiding the wire in a plane (E), wherein the guide arrangement has a straight course in the plane (E), wherein the guide arrangement and the shaping arrangement are arranged such that the wire, as it is advanced, is slid from the guide arrangement into the shaping arrangement.

5. The device according to claim 4, wherein the shaping arrangement and the guide arrangement are formed as part of a plate, wherein the plate is arranged after the advancing arrangement in an advancing direction of the wire, wherein the shaping arrangement has a first indentation in the plate with a curved course in the plane (E) of the plate, and the guide arrangement has a second indentation in the plate with a straight course in the plane of the plate, and wherein the first indentation within the plate directly adjoins the second indentation.

6. The device according to claim 1, wherein the pitch-producing arrangement is arranged such that the wire, as it is advanced in the shaping arrangement, is guided to the pitch-producing arrangement following bending in the shaping arrangement.

7. The device according to claim 1, wherein the pitch-producing arrangement is integrated in the shaping arrangement, such that the wire, as it is bent in the shaping arrangement, is also provided with a pitch at the same time.

8. The device according to claim 1, further comprising a receiving arrangement for positioning a core of an inductive component in the device, wherein the shaping arrangement and the pitch-producing arrangement are arranged around the receiving arrangement such that the wire is wound in a coiled manner around the core of the inductive component when the core of the inductive component is positioned in the receiving arrangement and the wire is guided through the shaping arrangement and the pitch-producing arrangement.

9. The device according to claim 1, further comprising a pre-bending arrangement configured to bend an end portion of the wire, wherein the wire is clampable in the advancing arrangement such that the end portion of the wire protrudes from the advancing arrangement, wherein the pre-bending arrangement is formed such that the end portion of the wire protruding from the advancing arrangement is movable to the shaping arrangement following bending by the pre-bending arrangement.

10. The device according to claim 9, wherein the pre-bending arrangement has a guide for receiving the wire, wherein the pre-bending arrangement is formed such that the pre-bending arrangement is displaceable from a first position at a distance from the end portion of the wire protruding from the advancing arrangement into a second position, in which the end portion of the wire protruding from the advancing arrangement lies in the guide of the pre-bending arrangement.

* * * * *